US005374334A

United States Patent [19]

Sommese et al.

[11] Patent Number: 5,374,334

[45] Date of Patent: Dec. 20, 1994

[54] CLASS OF POLYMERIC ADHESIVES FOR YANKEE DRYER APPLICATIONS

[75] Inventors: Anthony G. Sommese, Naperville; Gary S. Furman, Jr., St. Charles, both of Ill.

[73] Assignee: Nalco Chemical Company, Naperville, Ill.

[21] Appl. No.: 161,360

[22] Filed: Dec. 6, 1993

[51] Int. Cl.[5] ..... D21H 5/24

[52] U.S. Cl. ..... 162/111; 162/112; 162/168.2

[58] Field of Search ..... 162/111, 112, 113, 168.2, 162/168.3, 164.6; 264/282, 283

[56] References Cited

U.S. PATENT DOCUMENTS

| | | | |
|---|---|---|---|
| 2,926,116 | 2/1960 | Keim | 162/164.3 |
| 3,058,873 | 10/1962 | Keim et al. | 162/164.3 |
| 4,421,602 | 12/1983 | Brunamueller et al. | 162/168.2 |
| 4,441,602 | 4/1984 | Ostroski et al. | 194/100 A |
| 4,880,497 | 11/1989 | Pfohl et al. | 162/135 |
| 4,921,621 | 5/1990 | Costello et al. | 252/8.513 |
| 4,952,656 | 8/1990 | Lai et al. | 525/328.2 |
| 5,037,927 | 8/1991 | Itagaki et al. | 526/307.7 |
| 5,085,787 | 2/1992 | Pinschmidt, Jr. et al. | 252/8.551 |
| 5,126,395 | 6/1992 | End et al. | 524/801 |
| 5,179,150 | 1/1993 | Furman, Jr. et al. | 524/376 |
| 5,281,307 | 1/1994 | Smigo et al. | 162/168.2 |

OTHER PUBLICATIONS

"A Review of Chemical and Physical Factors Influencing Yankee Dryer Coatings", Gary S. Furman/Winston, Su, Nordic Pulp and Paper Research Journal No. 1/1993, pp. 217–222.

"Dry-Creping of Tissue paper–A Review of Basic Factors", John F. Oliver, Pulp and Paper Research Institute of Canada, Tappi, Dec. 1980, vol. 63 No. 12, pp. 91–95.

*Primary Examiner*—Peter Chin

*Attorney, Agent, or Firm*—Robert A. Miller; Joseph B. Barrett; James J. Drake

[57] ABSTRACT

The invention provides a method for manufacturing tissue paper. According to the method, a yankee dryer adhesive composition is applied to a metal surface of a drying drum. The yankee dryer adhesive composition preferably includes from about 1 to about 100 mole percent vinylamine and from about 1 to about 99 of at least one monomer selected from the group consisting of vinylformamide, vinyl acetate and vinyl alcohol. The yankee dryer adhesive composition is contacted with a continuous paper web. The continuous paper web is then dried. The dry continuous paper web is creped with a metal blade to form tissue paper.

14 Claims, No Drawings

CLASS OF POLYMERIC ADHESIVES FOR YANKEE DRYER APPLICATIONS

FIELD OF THE INVENTION

The invention comprises adhesive compositions which show good utility when used in the tissue manufacturing process as Yankee dryer coating agents. The adhesive compositions include a polymer containing vinylamine moieties.

BRIEF DESCRIPTION OF THE PRIOR ART

In the tissue manufacturing process, the paper sheet is dried by means of a steam heated drying cylinder, termed a Yankee. Adhesive materials are used to coat the Yankee surface in order to adhere the wet sheet to the dryer. This improves heat transfer, allowing more efficient drying of the sheet, and most importantly provides the required adhesion to give good creping of the dry sheet. Creping is the process of impacting the sheet into a metal blade, thus compressing the sheet in the machine direction, creating a folded sheet structure. Creping breaks a larger number of fiber-to-fiber bonds in the sheet, imparting the qualities of bulk, stretch, absorbency, and softness which are characteristic of tissue. The amount of adhesion provided by the coating adhesive plays a significant role in the development of these tissue properties.

The Yankee coating also serves the purpose of protecting the Yankee and creping blade surfaces from excessive wear. In this role, the coating agents provide improved runnability of the tissue machine. As creping blades wear, they must be replaced with new ones. This replacement process represents a significant source of tissue machine downtime, or lost production, as creped product cannot be produced when the blade is being changed. Also a problem, especially with the poly(aminoamide)-epichlorohydrin type creping adhesives is the phenomenon of coating buildup. Resins of this type are described in U.S. Pat. Nos. 2,926,116 and 3,058,873, the disclosure of which are incorporated herein by reference. This problem is evidenced by high spots in the coating, which cause chattering, or bouncing of the crepe blade, against the coated Yankee surface. Blade chatter results in portions of the sheet traveling underneath the crepe blade, causing picks or holes in the sheet. This can lead to sheet breaks and machine downtime.

The present invention provides a creping adhesive composition and method of using the same which provides both improved adhesion and improved machine runnability over other adhesive compositions known in the art. The invention provides a creping adhesive composition for creping cellulosic webs, the composition including crosslinked vinylamine containing polymers.

SUMMARY OF THE INVENTION

The invention provides a method for manufacturing tissue paper. According to the method, a yankee dryer adhesive composition is applied to a metal surface of a drying drum. The yankee dryer adhesive composition preferably includes from about 1 to about 100 mole percent vinylamine and from about 1 to about 99 of at least one monomer selected from the group consisting of vinylformamide, vinyl acetate and vinyl alcohol. The yankee dryer adhesive composition is contacted with a continuous paper web. The continuous paper web is then dried. The dry continuous paper web is creped with a metal blade to form tissue paper. Preferably, the polymers of the invention are crosslinked.

DESCRIPTION OF THE PREFERRED EMBODIMENTS

The invention provides a creping adhesive composition and a method of using the same. The invention provides an improved adhesion and improved runnability over other adhesive compositions. The invention uses a crosslinked vinylamine polymer to accomplish this goal. According to the invention, the polymer is a copolymer or terpolymer which contains from about 1 to about 100 mole percent vinylamine monomer and/or a monomer hydrolyzable to vinylamine, and/or from 1–99 mole percent of vinylformamide, vinyl acetate and vinyl alcohol.

For purposes of this invention, vinylamine monomers includes vinylamine and those monomers which are hydrolyzable to the following formula:

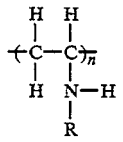

wherein:

R is, preferably, one substituent group selected from the group consisting of hydrogen and an alkyl group having from 1–10 carbon atoms. More preferably, R is hydrogen or is an alkyl group having 1–4 carbons.

The vinylformamide monomer of the invention is non-hydrolyzed and has the following structure:

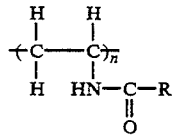

wherein:

R is, preferably, one substituent group selected from the group consisting of hydrogen and an alkyl group having from 1–10 carbon atoms. More preferably, R is hydrogen or is an alkyl group having 1–4 carbons.

One preferred method of producing vinylamine/vinyl alcohol containing polymers of the invention is to polymerize vinylformamide and vinyl acetate. Thereafter, the copolymer is hydrolyzed to a vinylamine/vinyl alcohol copolymer.

According to one embodiment of the invention, the creping adhesive composition includes a vinylamine/vinyl alcohol copolymer. Preferably, the copolymer will include from about 1 to about 99 mole % vinylamine and about 1 to about 99% vinyl alcohol. More preferably, the copolymer will include from about 10 to about 95 mole % vinyl alcohol and from about 90 to about 5 mole % vinylamine. Most preferably, the vinyl alcohol is included in the copolymer in an amount of from about 75 to about 95 mole % and the vinylamine is included in an amount of from about 5 to about 25 mole %.

According to a further embodiment of the invention, the creping composition includes vinylamine/vinylformamide copolymer. Preferably, the copolymer includes from about 1 to about 99% vinylamine and from about 1 to about 99% vinylformamide. More preferably, the copolymer includes from about 10 to about 50% vinylamine and from about 90 to about 50% vinylformamide. Most preferably, the copolymer includes from about 10 to about 20% vinylamine and from about 80 to about 90% vinylformamide.

Although the polymers of the present invention do not have to be crosslinked to have utility in the invention, preferably, the polymers are crosslinked with a crosslinking agent that will ultimately have an affinity for the hydroxyl groups of the cellulose fibers which form the tissue paper being produced. This affinity for the cellulose hydroxyl groups results in increased adhesion to the paper. In more detail, preferably, the crosslinking agents are either multi-functional organic compounds such as dialdehydes, haloepoxides polyepoxides, di- or triacrylates, di- or triisocyanates or dihalides, or inorganic compounds containing multi-valent anions or inorganic cations which are capable of complexing with poly(vinylamine). Among these agents, more preferably, the crosslinking agent is selected from the group consisting of dialdehydes, polyepoxides or dihalides. Most preferably, the crosslinking agent is a dialdehyde. The dialdehyde is preferably selected from the group consisting of glutaraldehyde and glyoxal. Most preferably, the dialdehyde is glutaraldehyde.

The polymers of the invention are crosslinked with from about 0.1 to about 5 mole percent of crosslinking agent based on the total amine. More preferably, the polymers of the invention are crosslinked with from about 0.5 to about 3 mole percent of crosslinking agent based on the total amine. Most preferably, the polymers of the invention are crosslinked with from about 1 to about 2 mole percent of crosslinking agent based on the total amine.

The compositions of the invention are preferably aqueous solutions. If, however, some preparations of the invention are gels at room temperature, additional water may be added to liquify the product. The adhesive composition of the invention may be applied in a spray form. Accordingly, although liquid compositions are preferred, gelled compositions have utility in the present invention. Preferably, the molecular weight of the polymers of the invention are from about 25,000 to about 500,000 dalton (da). More preferably, the molecular weight of the polymers of the invention are from about 50,000 to about 400,000 da. Most preferably, the molecular weight of the polymers of the invention are from about 75,000 to about 200,000 da.

The adhesive compositions of the present invention are applied to the surface of a creping cylinder as a dilute aqueous solution. Preferably, the aqueous solution includes from about 0.1 to about 10.0 weight percent of the polymers of the invention. More preferably, the polymers of the invention are included in the aqueous solution in a concentration of from about 0.25 to about 5.0 weight percent. Most preferably, the polymers of the invention are included in the aqueous solution in a concentration of from about 0.5 to about 2.0 weight percent. Those skilled in the art of creping adhesives will appreciate that the reason for such a larger percentage of water in the admixture is in part based on the need to only deposit a very thin layer of adhesive on the creping cylinder, which, in one embodiment, is most easily accomplished with a spray boom.

Processes for making the polymers of the invention prior to crosslinking are well known in the art. U.S. Pat. Nos. 5,126,395, 5,037,927, 4,952,656, 4,921,621, 4,880,497 and 4,441,602 all describe methods for preparing the polymers of the invention. Solution polymerization produces desirable high molecular weights. The resulting polymers of polyvinylformamide and vinyl acetate/vinylformamide are susceptible to alkaline or acid hydrolysis which converts some or all of the amide groups to amine groups and some or all of the ester groups to alcohols. This hydrolysis phenomena is described in U.S. Pat. No. 4,421,602, the disclosure of which is incorporated herein by reference. Thus, by controlling the stoichiometry of the hydrolyzing agent (acid or base), it is possible to produce vinylformamide/vinylamine copolymers or vinylamine/vinyl alcohol copolymers. Furthermore, by controlling the stoichiometry of the hydrolyzing agent, polymers derived from incomplete hydrolysis of polyvinylformamide or vinylformamide/vinyl acetate polymers can be produced. The polymer can contain the following monomer units: vinylamine; vinyl alcohol; vinylformamide; and vinyl acetate.

Generally, the production of tissue paper using the compositions of the invention on a Yankee dryer is a three step process comprising: a) applying to the surface of a creping cylinder an aqueous admixture of the compositions of the invention previously described; b) adhering a cellulosic web to the creping cylinder by the above said mixture and; c) dislodging the adhered web from the creping cylinder with a doctor blade.

The following examples are presented to describe preferred embodiments and utilities of the invention and are not meant to limit the invention unless otherwise stated in the claims appended hereto.

EXAMPLE 1

The relative adhesion of the creping adhesive compositions was measured by means of a peel test. In the test procedure, a paper sample was attached to a metal panel with the adhesive of interest, and peeled at an angle of 90°. The paper substrate used in the test was a filter grade paper obtained from Filtration Sciences. This paper had a basis weight of 78 g/m$^2$. The metal panels, to which the paper was adhered, were standardized test panels produced from low carbon steel and supplied with a smooth finish (surface roughness of 0.2–0.3 $\mu$m).

In the procedure, a 76 $\mu$m film of the adhesive was uniformly applied to a steel test panel by means of an applicator. The paper test strip was carefully applied to the film and rolled once with a weighted roller to achieve uniform contact between the paper, adhesive, and metal panel. The panel with attached paper strip was then mounted on the peel testing apparatus, the surface of which was controlled to a temperature of 100° C. When the sample was stabilized at this temperature, the paper strip was peeled form the panel and the average force needed to accomplish the separation was recorded. The strip was peeled from the panel at constant effective speed of 43 cm/min.

Results for the adhesives of this invention versus two commercially available resins are given in Table 1. The polymers of the invention crosslinked with glutaraldehyde show especially strong adhesion compared to Kymene® 557H and Rezosol® 8223. These commercially available resins gave essentially no adhesion at the testing level of 1% actives. Significant adhesion is not obtained for these resins until the actives level is increased to at least 2.5%. Paper failure occurs because the adhesive bond to the paper is so strong that the paper cannot be peeled or removed without tearing. Non-uniform adhesion is the phenomenon where the paper strip is adhered to the metal panel in certain places, while in other places on the metal panel, it is not adhered at all. The samples which were crosslinked with glutaraldehyde produced stronger adhesion.

TABLE 1

| Sample | Composition (VF/VA) | Peel Adhesion Conc. | Peel Adhesion Avg. |
|---|---|---|---|
| I | 90/10 (glutaraldehyde crosslinked) | 1.00 | PF |
| | | 0.50 | PF |
| | | 0.40 | 14.1 ± 1.3 |
| | | 0.25 | NA |
| II | 100/0 | 1.00 | PF |
| | | 0.50 | 8.5 ± 3.5 |
| III | 0/100 | 1.00 | NUA |
| IV | 50/50 | 0.95 | NUA |
| Kymene 557H | | 1.0% | .2 |
| Rezosol 8223 | | 1.0% | NA |

PF = paper failure
NA = no adhesion
NUA = non-uniform adhesion

Additional adhesion results are summarized in Table 2. The polymers tested are listed in Table 3. Samples II, III and IV of Table 1, which were not crosslinked, provided adhesion of the paper test strips to the metal test panels but it was non-uniform.

TABLE 2

| Sample | Conc. (%) | Peal Adhesion (g/in) |
|---|---|---|
| A | 1.2 | 47.9 |
| B | 1.2 | 14.2 |
| C | 1.2 | 51.3 |
| A | 1.4 | 10.9 |
| B | 1.4 | 8.8 |
| C | 1.5 | 6.4 |
| E | 0.75 | 73.0 |
| F | 0.75 | 63.6 |

TABLE 3

| Sample | Composition | Crosslinker Level (%)* | Nominal Solids (%) | Comments |
|---|---|---|---|---|
| A | 100 VA | 1 | 4 | liquid |
| B | 100 VA | 3 | 4 | gel |
| C | 100 VA | 5 | 4 | gel |
| D | 85/15 VA/VOH | 1 | 5 | liquid |
| E | 85/15 VA/VOH | 3 | 5 | liquid |
| F | 85/15 VA/VOH | 5 | 5 | gel |
| G | 6/94 VA/VOH | 25 | 4 | liquid |
| H | 6/94 VA/VOH | 50 | 4 | liquid |

*mole of glutaraldehyde/mole vinylamine
VA = vinylamine
VOH = vinyl alcohol

Changes can be made in the composition, operation and arrangement of the method of the present invention described herein without departing from the concept and scope of the invention as defined in the following claims:

What is claimed is:

1. A method for manufacturing tissue paper, the method comprising the steps of:

a) applying a yankee dryer adhesive composition to a metal surface of a drying drum, the yankee dryer adhesive composition is a crosslinked polymer including from about 1 to about 100 mole percent vinylamine and from about 1 to about 99 of at least one monomer selected from the group consisting of vinylformamide, vinyl acetate and vinyl alcohol;

b) contacting the yankee dryer adhesive composition with a continuous paper web;

c) drying the continuous paper web; and d) creping the dry continuous paper with a metal blade to form tissue paper.

2. The method of claim 1 where the polymer contains from about 50 to about 99 mole percent of vinylamine.

3. The method of claim 1 where the polymer is a copolymer which contains from about 10 to about 90 mole percent of vinylformamide.

4. The method of claim 1 where the polymer contains from about 80 to about 99 mole percent of vinylamine.

5. The method of claim 1 where the polymer is a homopolymer of polyvinylamine.

6. The method of claim 1 wherein the polymer is crosslinked with one crosslinking agent selected from the group consisting of glutaraldehyde, glyoxal and epichlorohydrin.

7. The method of claim 1 wherein the polymer is crosslinked with from about 0.1 to about 5 mole percent of a crosslinking agent based on the total amine.

8. A method for manufacturing tissue paper, the method comprising the steps of:

a) applying a yankee dryer adhesive composition to a metal surface of a drying drum, the yankee dryer adhesive composition is a polymer including from about 1 to about 100 mole percent vinylamine and from about 1 to about 99 of at least one monomer selected from the group consisting of vinylformamide, vinyl acetate and vinyl alcohol;

b) contacting the yankee dryer adhesive composition with a continuous paper web;

c) drying the continuous paper web; and d) creping the dry continuous paper with a metal blade to form tissue paper.

9. The method of claim 8 where the polymer contains from about 50 to about 99 mole percent of vinylamine.

10. The method of claim 8 where the polymer is a copolymer which contains from about 10 to about 90 mole percent of vinylformamide.

11. The method of claim 8 where the polymer contains from about 80 to about 99 mole percent of vinylamine.

12. The method of claim 8 where the polymer is a homopolymer of polyvinylamine.

13. The method of claim 1 wherein the polymer is crosslinked with glutaraldehyde.

14. The method of claim 1 wherein the polymer is crosslinked with from about 0.5 to about 3 mole percent of a crosslinking agent based on the total amine.

* * * * *